US007955101B2

(12) United States Patent
Lawson et al.

(10) Patent No.: US 7,955,101 B2
(45) Date of Patent: Jun. 7, 2011

(54) MODIFIABLE ELECTRICAL CONNECTOR LUG

(75) Inventors: Craig E. Lawson, Amherst, NH (US); Normand L. Castonguay, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/287,352

(22) Filed: Oct. 7, 2008

(65) Prior Publication Data

US 2010/0087106 A1 Apr. 8, 2010

(51) Int. Cl.
*H01R 29/00* (2006.01)

(52) U.S. Cl. ..... 439/177; 439/883; 439/516

(58) Field of Classification Search ..... 439/884, 439/177, 883, 516, 475, 154, 165, 923, 877
See application file for complete search history.

(56) References Cited

U.S. PATENT DOCUMENTS

| | | | | | |
|---|---|---|---|---|---|
| 1,788,354 | A | | 1/1931 | Alden | |
| 2,317,168 | A | * | 4/1943 | Ball, Jr. | 136/229 |
| 2,406,079 | A | | 8/1946 | Krueger | 439/878 |
| 2,748,452 | A | | 6/1956 | Pierce | 439/885 |
| 3,082,397 | A | | 3/1963 | Clarkson et al. | 339/157 |
| 3,478,722 | A | | 11/1969 | Falcone et al. | 119/23 |
| 3,760,326 | A | | 9/1973 | Windsor | 339/14 R |
| 3,761,867 | A | | 9/1973 | Churla | 439/883 |
| 3,813,645 | A | * | 5/1974 | Elliott et al. | 439/854 |
| 4,196,960 | A | | 4/1980 | Gelfand | 339/275 T |
| 4,290,665 | A | | 9/1981 | Krasnov et al. | 439/886 |
| 4,555,749 | A | | 11/1985 | Rifkin et al. | 362/249 |
| 4,679,888 | A | * | 7/1987 | Williams | 439/883 |
| 4,753,609 | A | | 6/1988 | Pfeffer et al. | 439/541 |
| 4,771,538 | A | * | 9/1988 | O'Loughlin et al. | 29/874 |
| 4,793,820 | A | * | 12/1988 | Czech et al. | 439/177 |
| 4,832,622 | A | | 5/1989 | Zahn | 439/590 |
| 4,832,629 | A | * | 5/1989 | Sasaki et al. | 439/792 |
| 5,145,415 | A | | 9/1992 | Doudon | 439/621 |
| 5,281,761 | A | | 1/1994 | Woo et al. | 174/78 |
| 6,206,718 | B1 | * | 3/2001 | Takahashi et al. | 439/382 |
| 6,280,263 | B1 | | 8/2001 | Manor et al. | 439/801 |
| 6,334,539 | B1 | | 1/2002 | Jajko et al. | 211/42 |
| 6,361,375 | B1 | | 3/2002 | Sinclair | 439/723 |
| 6,623,885 | B1 | * | 9/2003 | Watanabe et al. | 429/178 |
| 6,640,605 | B2 | | 11/2003 | Gitlin et al. | 72/379.2 |
| 6,783,377 | B2 | * | 8/2004 | Aoyama | 439/92 |
| 7,118,430 | B1 | * | 10/2006 | Henry et al. | 439/884 |
| 7,137,833 | B2 | | 11/2006 | Woodward | 439/115 |
| 7,467,968 | B1 | * | 12/2008 | Sink et al. | 439/491 |
| 2008/0115822 | A1 | * | 5/2008 | Cunningham et al. | 136/244 |
| 2008/0182462 | A1 | | 7/2008 | Werthman et al. | 439/884 |

OTHER PUBLICATIONS

"Types YAV Box and YAV", 2005 Burndy Master Catalog, pp. 74-75.
"Compression Terminal is made of copper and aluminum", ThomasNet Industrial NewsRoom Newsletters, Aug. 29, 2008, 1 pg.

* cited by examiner

*Primary Examiner* — Michael C Zarroli
(74) *Attorney, Agent, or Firm* — Harrington & Smith

(57) ABSTRACT

An electrical connector including a first connection section adapted to connect the electrical connector to a first conductor; and a second connection section connected to the first connection section. The second connection section includes a lug having a hole configured to be located onto a mounting post. The second connection section has a substantially straight shape with the electrical connector having a first predetermined product safety certification. The second connection section includes a recess on a top side forming a weakened line across the second connection section for bending the second connection section at the weakened line from the substantially straight shape to a bent shape forming a modified electrical connector having a second different predetermined product safety certification.

17 Claims, 5 Drawing Sheets

MODIFIABLE ELECTRICAL CONNECTOR LUG

BACKGROUND OF THE INVENTION

1. Field of the Invention

The invention relates to an electrical connector and, more particularly, to an electrical connector having a connector lug which can be modified.

2. Brief Description of Prior Developments

Electrical contacts which have a lug with one or more holes for connecting two electrical conductors to each other are well known in the art. For example, FCI USA, Inc. sells BURNDY® one hole and two hole HYLUG™ electrical conductors for connecting a wire or cable to another electrical conductor having one or two connection posts, respectively. The connection post(s) are received in the hole(s) of the lugs.

In cases where a two-hole lug is too long for a particular application, installers are cutting the two-hole lugs with saws to make a one-hole lug. The problem is that only the two-hole lug is UL (Underwriters Laboratory, Inc.) approved. Modifications to the two-hole lug could void the UL approval, especially if an installer gets a bit aggressive while removing the extra lug hole portion of the two-hole lug and removes too much material.

U.S. Pat. No. 4,753,609 teaches a first metal contact and a second metal contact. The contacts are stamped from the same sheet of metal, and the second contacts are subsequently broken away from the first contacts along a crease. Other art teaches break-away portions to shorten (or extend) overall length.

SUMMARY OF THE INVENTION

In accordance with one aspect of the invention, An electrical connector including a first connection section adapted to connect the electrical connector to a first conductor; and a second connection section connected to the first connection section. The second connection section includes a lug having a hole configured to be located onto a mounting post. The second connection section has a substantially straight shape with the electrical connector having a first predetermined product safety certification. The second connection section includes a recess on a top side forming a weakened line across the second connection section for bending the second connection section at the weakened line from the substantially straight shape to a bent shape forming a modified electrical connector having a second different predetermined product safety certification.

In accordance with another aspect of the invention, a method of manufacturing an electrical connector is provided comprising providing a first connection section configured to be connected to a first conductor and a second connection section connected to the first connection section, wherein the second connection section comprises a lug having a mounting hole configured to be mounted onto a mounting post, wherein the second connection section extends relatively straight from the first connection section at a first direction in a general cantilever fashion; and providing a weakened section between the first and second connection sections, wherein the electrical connector is configured to be bent at the weakened section such that the second connection section extends relatively straight from the first connection section at a second direction, angled relative to the first direction, in a general cantilever fashion, wherein the weakened section comprises a stop to limit bending of the first and second connection sections relative to each other to a predetermined angle.

In accordance with another aspect of the invention, a method is provided comprising providing an electrical connector comprising a first connection section adapted to connect the electrical connector to a first conductor, a second connection section connected to the first connection section, wherein the second connection section comprises a lug having a hole configured to be located onto a mounting post, and a recess on a top side forming a weakened line across the electrical connector between the first and second connection sections, wherein the electrical connector has a first predetermined configuration; and bending electrical connector at the groove wherein opposite side walls of the groove contact each other to limit an angle of bending of the first and second connection sections relative to each other to a predetermined angle, wherein the electrical

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
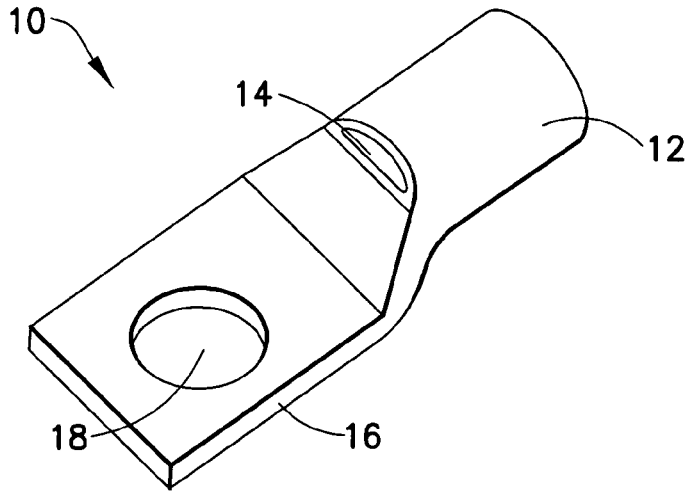
FIG. 1 PRIOR ART
FIG. 1 is a perspective view of a conventional electrical connector.

Referring to FIG. 1, there is shown a perspective view of a conventional electrical connector 10. The connector 10 is a BURNDY® one hole HYLUG™ electrical conductor. The connector 10 generally comprises a tube section 12 forming a cable receiving area with an inspection window 14, and a lug section 16 with a single hole 18. As seen with reference to FIG. 2, the connector 10 can be mounted on a mounting post 20 of another member 22 to electrically connect a wire or cable 24 to the member 22. The tube section 12 can be crimped onto the cable 24. The lug section 16 can be retained on the post 20 by a fastener 26, such as a threaded nut.

Figure 3:
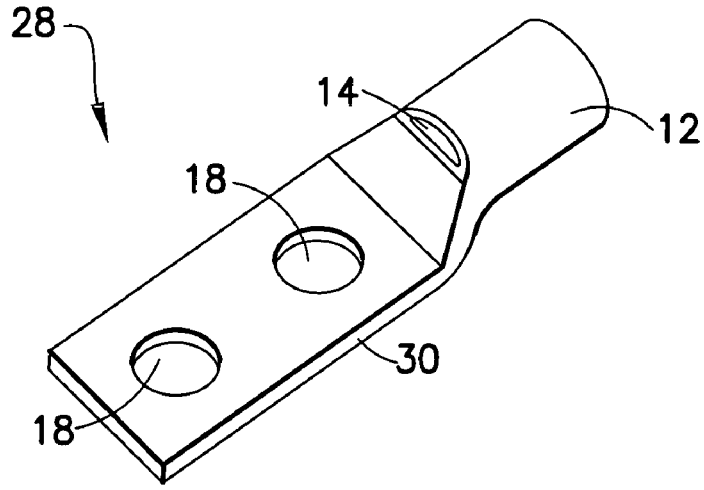
FIG.3 PRIOR ART
FIG. 3 is a perspective view of another embodiment of a conventional electrical connector.

Referring also to FIG. 3, a perspective view of another conventional electrical connector 28 is shown. The connector 28 is a BURNDY® two hole HYLUG™ electrical conductor. The connector 10 generally comprises a tube section 12 forming a cable receiving area with an inspection window 14, and a lug section 30 with two holes 18. The lug section 30 is mounted to another member by receiving two mounting posts; one in each one of the holes 18.

The two hole connector 28 is used rather than the one hole connector 10 because a larger surface area of contact between the connector and the other member (such as along the bottom surface of the lug section) is needed for electrical reasons. However, the one hole connector 10 can be used in some circumstances rather than the two hole connector 28 because the one hole connector 10 can be less expensive than the two hole connector 28.

Figure 2:
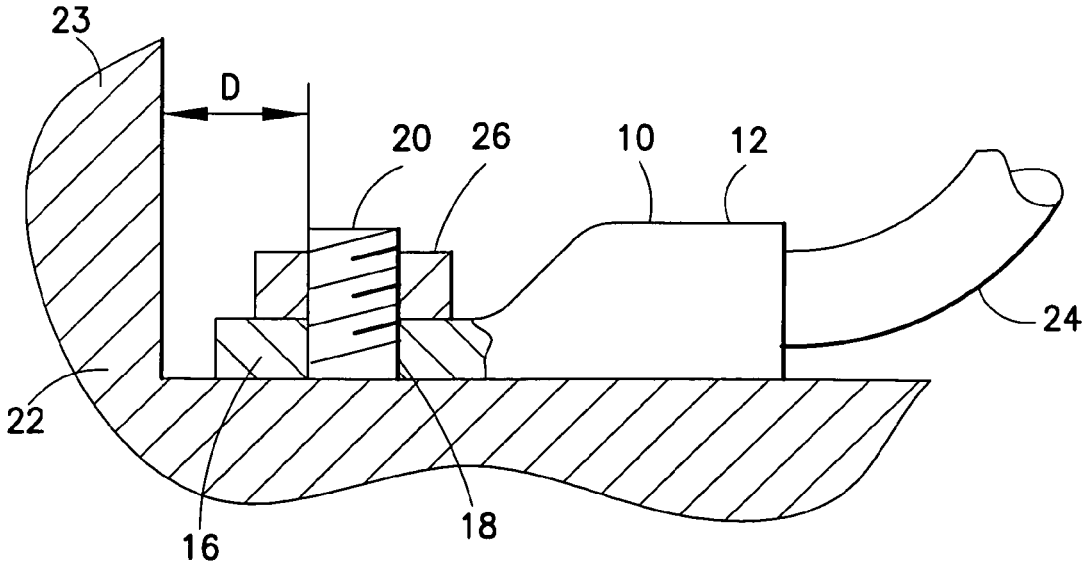
FIG. 2 PRIOR ART
FIG. 2 is an illustration showing the electrical connector of FIG. 1 being used to connect two conductors to each other.

As can be seen with reference to FIG. 2, in some circumstances, because of the environment, only enough space is available for a one hole connector to be used. For example, the distance D between the post 20 and portion 23 of the member 22 might not allow the lug section 30 to be installed. The size of the lug section 30 of the two hole connector 28 would be too large for use in the available area for the connector. However, a user might only have the two hole connector 28 available. In this instance, as noted above, installers are cutting the two-hole lug section 30 with a saw to make a one-hole lug section. The problem is that only the whole connector having the two-hole lug section is UL approved. Modifications to the two-hole lug could void the UL approval, especially if an installer gets a bit aggressive while removing the extra lug hole portion of the two-hole lug.

Figure 4:
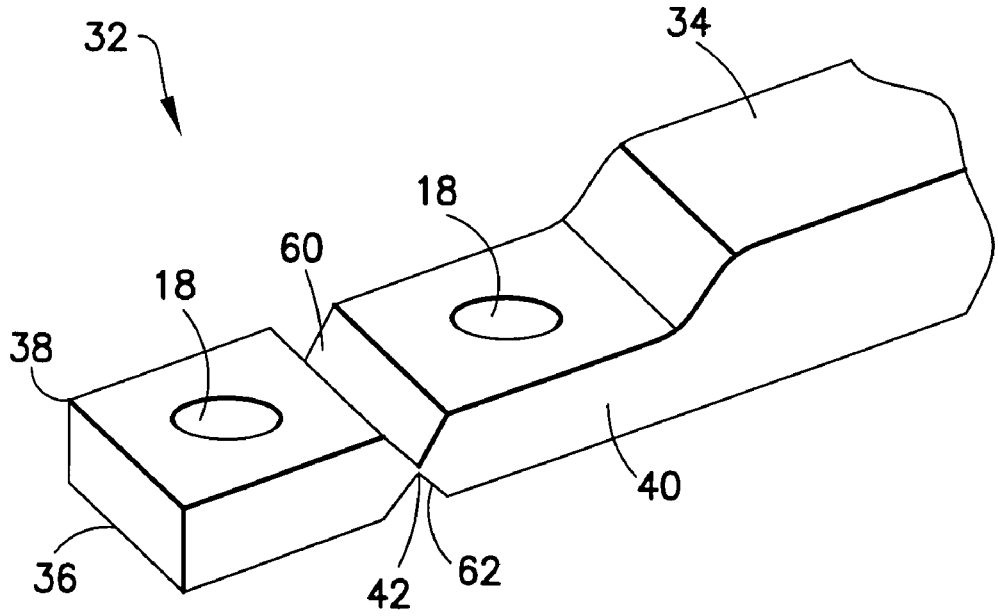
FIG. 4 is a perspective view of an electrical connector comprising features of the present invention.

Referring now to FIG. 4, a perspective view of a portion of an electrical connector 32 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The connector 32 generally comprises a one-piece metal member having a first connection section 34 and a second connection section 36. The first connection section 34 could comprise any suitable connection section for connection to another member, such as a tube section to be crimped onto a wire or cable for example. The second connection section 36 is a lug section or pad or tongue having two mounting holes 18 similar to the connector 28 shown in FIG. 3. However, the lug section 36 has a front portion 38 and a rear portion 40 connected by a weakened section 42. The weakened section 42 comprises laterally extending recesses 60, 62 along the top and bottom sides of the lug section 36 between the front portion 38 and the rear portion 40. The weakened section 42 provides a section of the lug which has a different cross section than the rest of the lug. Preferably, this reduced cross section is weaker than the cross section of the lug at the holes 18. In alternate embodiments, only the top side recess 60 or the bottom side recess 62 could be provided. In another alternate embodiment one or both recesses could comprise a series of non-connected indentations or holes through the height of the lug section. In alternate embodiments, any suitable type or shape of weakened section could be provided.

Figure 5:
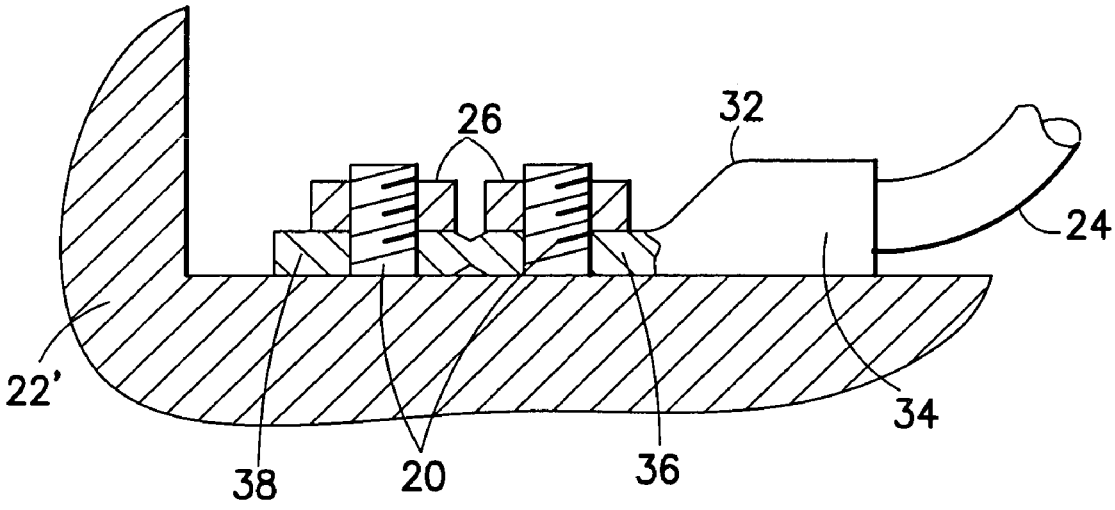
FIG. 5 is a side view of the electrical connector shown in FIG. 4 being used to connect two conductors together.
Figure 6:
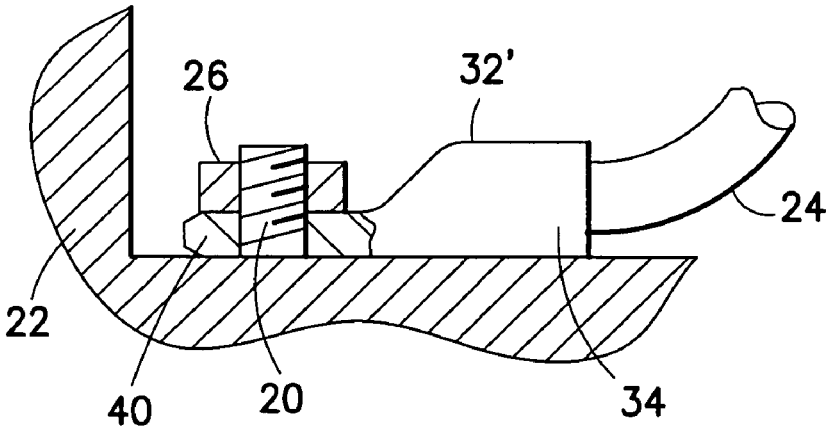
FIG. 6 is a side view of the electrical connector shown in FIG. 4 with a front lug portion removed and being used to connect two conductors together.

The weakened section 42 allows a user to separate the front portion 38 from the rear portion 40 in a controlled manner. With multiple connectors 32, the separation can be performed in a repeatable manner. As shown in FIG. 5, the connector 32 can be used to connect the cable 24 to the member 22' without separating the front portion 38. The lug section 36 can be mounted to the two posts 20 with the fasteners 26. However, as shown in FIG. 6, the same connector can be modified by a user/installer by removing the front portion 38 to form the connector 32' for connection to the member 22.

The separation of the front portion 38 from the rear portion 40 could comprise, for example, the use of pliers to bend the lug section at the weakened section and, through metal fatigue, break the weakened section. As another example, a saw could be used to cut the weakened section with the groove(s) of the weakened section forming a guide for the saw. In an alternate embodiment, more than two lug portions could be provided and more than one weakened section could be provided.

With the invention, an existing two-hole lug can be fitted or re-designed with one or more grooves 60, 62 so that the two-hole lug can be modified into a one-hole lug as described above. In a preferred method, the connector will be UL approved in both its one-hole version, such as 32' for example, and its multi-hole version, such as 32 for example. Thus, with the invention, a two-hole lug can be modified, in a controlled, reproducible manner into a one-hole lug without voiding the UL approval.

Figure 9:
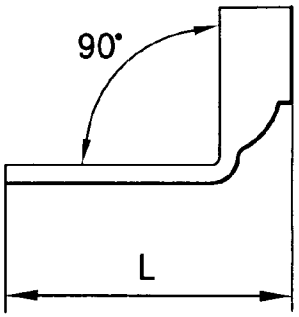
FIG. 9 is a side view of another alternate embodiment of the electrical connector shown in FIG. 7.
Figure 8:
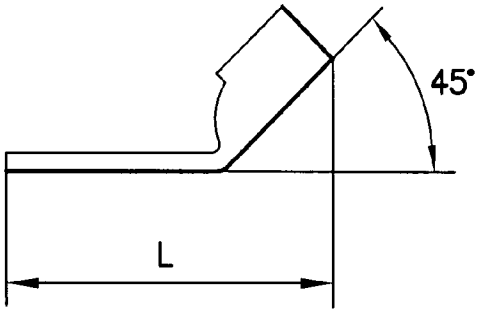
FIG. 8 is a side view of an alternate embodiment of the electrical connector shown in FIG. 7.
Figure 7:
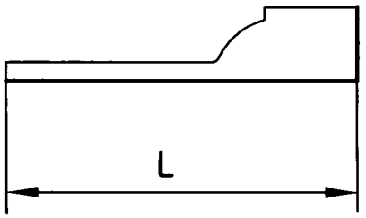
FIG. 7 is a side view of the electrical connector shown in FIG. 4.

Two-hole lugs are known. Cutting two-hole lugs with a saw to make one-hole lugs is also known. Using break-away segments to decrease (or increase) length of an object is also known. However, with the invention, the unexpected result of a guaranteed UL approval for both the two-hole lug and the modified one-hole lug can be provided. FIGS. 7-9 illustrate that features of the invention can be used with the first and second connection sections angled at different angles relative to each other.

Figure 10:
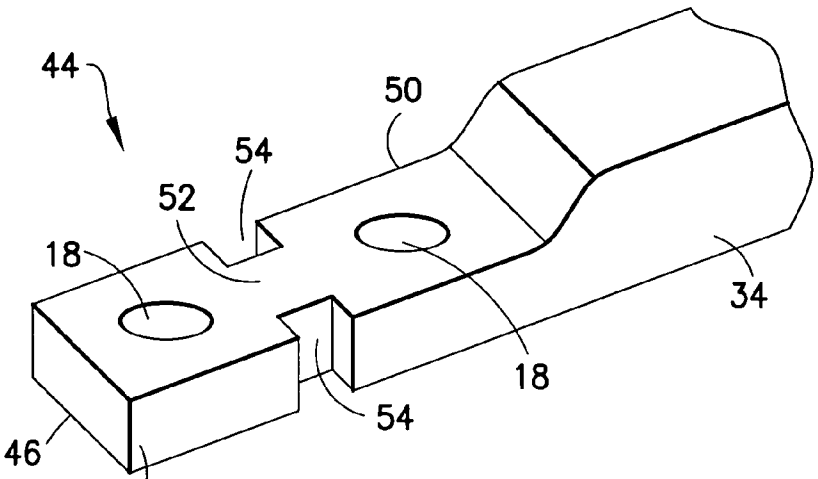
FIG. 10 is a perspective view of another alternate embodiment of the electrical connector shown in FIG. 4.
Figure 11:
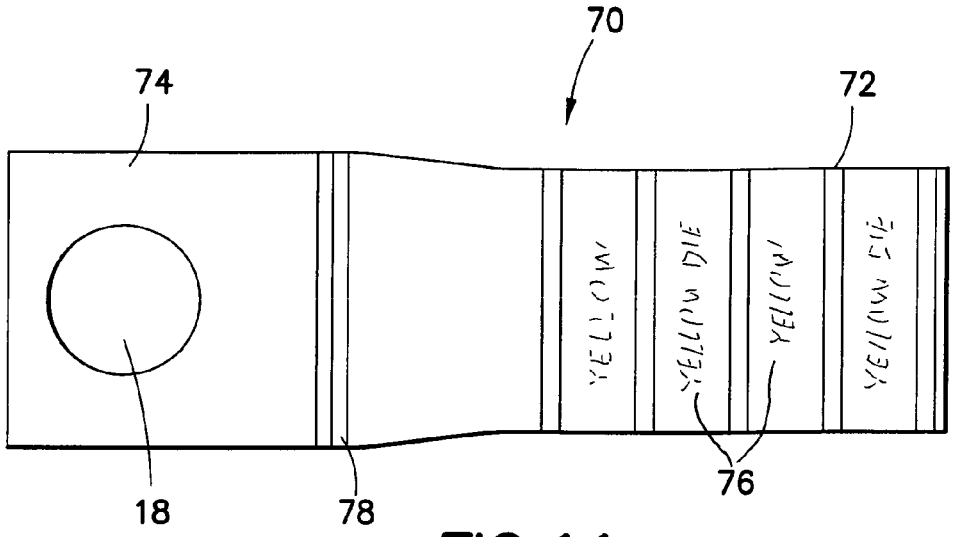
FIG. 11 is a plan top view of an alternate embodiment of the invention.

FIG. 10 is a partial perspective view of another embodiment of the invention. In this embodiment, The connector 44 generally comprises a one-piece metal member having a first connection section 34 and a second connection section 46. The first connection section 34 could comprise any suitable connection section for connection to another member, such as a tube section to be crimped onto a wire or cable for example. The second connection section 46 is a lug section having two mounting holes 18 similar to the connector 28 shown in FIG. 3. The lug section 46 has a front portion 48 and a rear portion 50 connected by a weakened section 52. The weakened section 52 comprises inwardly extending recesses 54 at lateral sides of the lug section 46 between the front portion 38 and the rear portion 40. The weakened section 52 allows a user to separate the front portion 48 from the rear portion 50 in a controlled manner. With multiple connectors 44, the separation can be performed in a repeatable manner.

There are many instances during connector installations in which there is a need to quickly modify a pad or tongue of an electrical connector in order to suit limitations in the installation or in the overall application. Specifically, it is necessary to modify the length or size of a pad/tongue so that a long size pad can be modified to create a short size pad.

Current solutions to this dilemma include the use of a vice, hacksaw or other means to cut, shear and remove the material. These are time consuming and "ugly" solutions that could result in inconsistent results at best, or unacceptable results as worst. A solution is needed that will allow for easy modification of existing designs that will provide consistently modified product, safely and still with electrical continuity.

The solution is integrated into the design of the invention. A preferred embodiment would include the inclusion of a crease or seam in the pad, which still provides the necessary electrical cross-section if the pad was to be used as-is, but will also allow the user to easily remove the excess pad that may not be needed in the application. The use of a pair of channel-lock pliers or other non-cutting means will allow for an easy, safe, and electrically compliant installation and solve the dilemma faced by installers in the field.

The embodiments shown in FIGS. 7 and 8 are completely different connectors. The length L8 of the connector shown in FIG. 8 is less than the length L7 of the connector shown in FIG. 7. This allows for use of the connector shown in FIG. 8 in tighter spaces. However, referring also to FIGS. 11-14 another embodiment of the invention will be described. In this embodiment the electrical connector 70 is a one-piece metal member comprising a first connection section 72 and a second connection section 74. The first connection section 72 has a general tube shape for receiving an end of a conductor. In this embodiment the first connection section 72 has indicia 76 for indicating to a user where the first connection section 72 should be crimped onto the inserted conductor.

The second connection section 74 comprises a lug with a hole 18. The lug is substantially flat and extends away from the first connection section 72 in a general cantilever fashion. The hole 18 is sized and shaped to receive a mounting post therethrough. The second connection section 74 could comprises the shapes shown in FIGS. 4 or 10 for example. In this embodiment the top side of the electrical connector comprises a groove 78, such as a skive for example. The groove 78 is located between the first and second connection sections 72, 74. The groove extends across the entire width of the connector. In this embodiment the groove 78 has a general V shape cross section with two opposing walls 80, 82. The shape could be different from a V shape, and the groove could be intermittent. The walls 80, 82 are angled relative to each other at an angle 84. In the preferred embodiment shown, the angle 84 is 90 degrees. However, the angle 84 could be more or less than 90 degrees. The depth of the groove 78 into the top side of the connector is preferably less than half the height of the connector at that section.

Figure 12:
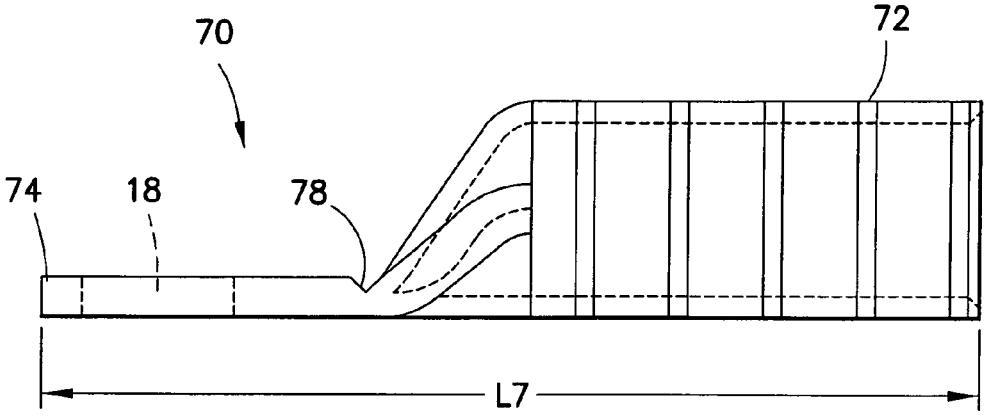
FIG. 12 is a side view of the connector shown in FIG. 11 in a first configuration.
Figure 13:
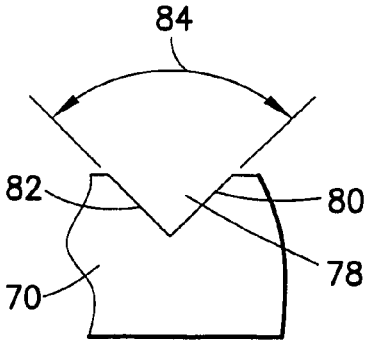
FIG. 13 is a partial enlarged side view of a portion of the connector shown in FIG. 12.

FIG. 12 generally shows the connector 70 in a straight configuration with a length L7 similar to that shown in FIG. 7. This configuration would be submitted to a certification company, such as Underwriters Laboratories (UL) or Canadian Standards Association (CSA), for a safety certification in this first configuration.

Figure 14:
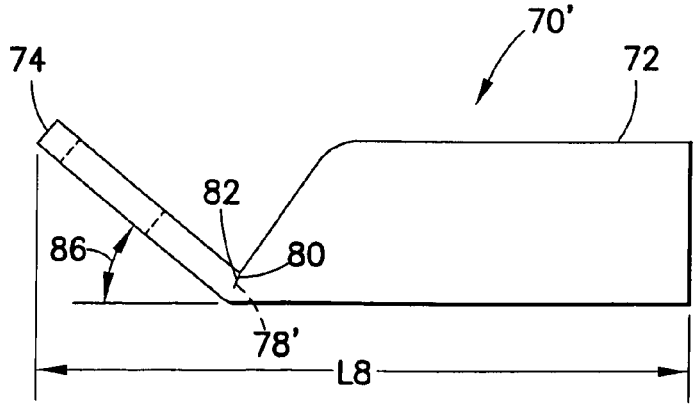
FIG. 14 is a side view of the connector shown in FIG. 11 is a second configuration.

Referring also to FIG. 14, the connector 70 can be changed from the first configuration shown in FIG. 12 to the connector 70' having a second configuration shown in FIG. 14. More specifically, the first and second connection sections 72, 74 can be bent relative to each other at the groove 78 to form a closed groove 78' with the walls 80, 82 now contacting each other. Because the angle 84 of the grove 78 was 90 degrees, the resulting new angle 86 between the first and second connection sections is 45 degrees.

The walls 80, 82 function as a stop or limit to limit the angle 86 to a predetermined desired angle of the first and second connection sections relative to each other in the second configuration. It functions as a built in gauge. So long as the user bends the first and second connection sections 72, 74 a sufficient amount such that the walls 80, 82 touch each other, no further measurements are needed to insure that the two connection sections 72, 74 are at the predetermined desired angle relative to each other. The bending of subsequent additional connectors from the first configuration to the second configuration is repeatably accurate and results in the same second product 70'. The resultant length L8 is smaller than the length L7. Thus, the connector 70' in the second configuration can be used in a smaller space than the connector 70 in the first configuration. This configuration would be submitted to a certification company, such as Underwriters Laboratories (UL) or Canadian Standards Association (CSA), for a safety certification in this second configuration.

The invention can provided a field adaptable angle feature for an electrical connector. In other words, a first connector can be adapted or reconfigured in the field by an installer; not necessarily in the factory. One hole or multi-hole lug terminals are able to be modified in the field from a standard straight terminal up to a 45 degree angle terminal while maintaining UL and/or CSA certification. The terminals could feature a built in angle-capability feature that would allow an installer to modify the terminal (in the field) from a straight configuration up to a 45 degree angle bend. The angle-capability feature could be built into the terminal and could insure a controlled bend at the required position that results in a uniform bend while maintaining the terminal's electrical integrity.

The built in angle-capability feature could be best described as a "built in gauge" in the terminal that acts as a stop when a 45 degree angle bend is reached. A skive or groove 78 is put into the top of the terminal pad. The skive controls the location of the bend in the pad and serves as a built in gauge for the installer. The location of the groove 78 is preferably next to the first connection section 72. This is because, if the groove 78 was further away from the first connection section 72, the weight of the conductor extending into the first connection section 72 and the distance to the groove could result in a moment being sufficiently large to result in the connector deforming back towards its straight shape. Thus, the smallest length from the groove to the first connection section is desired to avoid this occurrence and problem of an excessively large moment. The groove 78 is preferably made in a uniformly flat section of the connector at the start of the lug. This could insure manufacturing repeatability and manufacturing quality control.

The benefit of the connector is that it affords the installer the flexibility to modify a standard straight terminal into an angled terminal in the field as the application dictates. The flexibility for an installer to be able to modify a straight terminal to a terminal that could be angled up to 45 degrees while maintaining both UL and CSA listing's would be unique.

The terminal could be copper or aluminum, for example, and the terminal could be of a narrow tongue design and accommodate a wide variety (AWG, DLO, Flex and Metric) of conductor configurations. The terminals could accommodate a range of conductors provided they are installed with the required tooling (such as BURNDY Y644 and PAT644 crimping tool Platforms for example). One idea is a crease (skive) in the connector that permits the conductor receiving end to pivot with respect to the lug. The amount of pivot is limited to 45 degrees.

Currently, electrical connector terminal are certified by UL or CSA with a safety certification in only one configuration. Thus, if an installer modifies the terminal in the field, this could void the safety certification for that connector terminal. With the invention, on the other hand, because reconfiguring the connector 70 from the first configuration into the connector 70' having the second configuration is easily repeatable in the field without any special additional gauges or tools, it is possible to have the electrical connector certified by UL and/or CSA in both its first and second configurations.

Hence, when installed by an installer in the field, the safety certification of UL and/or CSA will exist and not be voided regardless of whether the installer uses the connector 70 in its first configuration or if the installer bends the first and second connections sections 72, 74 relative to each other the predetermined limited amount into the connector 70' having the second configuration. Having the connector UL and/or CSA certified, regardless of its predetermined first or second configuration, can insure safety of the connector and prevent unnecessary litigation if the connector 70 needs to be modified in the filed in order to be installed properly in a small space environment. The built in gauge feature of the groove 78 having predetermined stops to limit bending to a predetermined bend allows this feature to be provided.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An electrical connector comprising:

a first connection section adapted to connect the electrical connector to a first conductor; and a second connection section connected to the first connection section, wherein the second connection section comprises a lug having a hole configured to be located onto a mounting post, wherein the second connection section has a substantially straight shape relative to the first connection section with the electrical connector having a first predetermined product safety certification, and wherein the second connection section comprises a recess on a top side forming a weakened line across the second connection section for bending the second connection section at the weakened line from the substantially straight shape to a bent shape forming a modified electrical connector having a second different predetermined product safety certification;

wherein the first and second connection sections comprise a one-piece member.

2. An electrical connector as in claim 1 wherein the first connection section comprises a tube section.

3. An electrical connector as in claim 1 wherein the first connection section is configured to be crimped onto the first conductor, and wherein the electrical connector is a one-piece metal member comprising only the first connection section and the second connection section.

4. An electrical connector as in claim 1 wherein the lug is substantially flat and extends away from the first connection section in a general cantilever fashion.

5. An electrical connector as in claim 1 wherein the recess has a general V shape.

6. An electrical connector as in claim 1 wherein the recess comprises a limit feature adapted to limit an angle of bend of the second connection section to a predetermined angle.

7. An electrical connector as in claim 6 wherein the predetermined angle is about 45 degrees.

8. An electrical connector as in claim 1 wherein the recess is sized and shaped to limit an angle of bend of the second connection section to a predetermined angle.

9. An electrical connector as in claim 1 wherein the second connection section comprises a stop to limit an angle of bend of the second connection section to a predetermined angle.

10. An electrical connector as in claim 9 wherein the stop comprises a wall of the recess.

11. An electrical connector as in claim 1 wherein the recess extends into the top side less than half a thickness of the lug.

12. An electrical connector as in claim 1 wherein the recess is uniform across the entire width of the lug.

13. An electrical connector as in claim 1 wherein first predetermined product safety certification is for the electrical connector as a straight connector with the first and second connections sections not being bent relative to each other, and the second different predetermined product safety certification is for the electrical connector as a bent connector with the first and second connections sections being bent relative to each other at an angle of about 45 degrees.

14. An electrical connector as in claim wherein the first connection section comprises a tube section, wherein the first and second connection sections comprise a one-piece metal member, wherein the lug is substantially flat and extends away from the first connection section in a general cantilever fashion, wherein the recess is located proximate a junction of the first and second connection sections.

15. An electrical connector comprising:

a first connection section adapted to connect the electrical connector to a first conductor, wherein the first connection section comprises a tube section; and a second connection section connected to the first connection section, wherein the second connection section comprises a lug having a hole configured to be located onto a mounting post, wherein the second connection section has a substantially straight shape with the electrical connector having a first predetermined product safety certification, wherein the second connection section comprises a recess on a top side forming a weakened line across the second connection section for bending the second connection section at the weakened line from the substantially straight shape to a bent shape forming a modified electrical connector having a second different predetermined product safety certification, and wherein the recess is located proximate a junction of the first and second connection sections.

16. An electrical connector comprising:

a first connection section adapted to connect the electrical connector to a first conductor, wherein the first connection section comprises a tube section; and a second connection section connected to the first connection section, wherein the first and second connection sections comprise a one-piece metal member, wherein the second connection section comprises a lug having a hole configured to be located onto a mounting post, wherein the lug is substantially flat and extends away from the first connection section in a general cantilever fashion, and wherein the second connection section comprises a recess on a top side forming a weakened line across the second connection section for bending the second connection section at the weakened line from the substantially straight shape to a bent shape forming a modified electrical connector, and wherein the recess is located proximate a junction of the first and second connection sections.

17. An electrical connector as in claim 16 wherein the second connection section has a substantially straight shape with the electrical connector having a first predetermined product safety certification, and wherein the modified electrical connector is configured to have a second different predetermined product safety certification.

* * * * *